US006085145A

United States Patent [19]

Taka et al.

[11] Patent Number: 6,085,145

[45] Date of Patent: Jul. 4, 2000

[54] AIRCRAFT CONTROL SYSTEM

[75] Inventors: Yasuhiro Taka; Masao Nishida; Toshikazu Nakajima; Ryuji Otsuka, all of Tokyo, Japan

[73] Assignee: Oki Electric Industry Co., Ltd., Tokyo, Japan

[21] Appl. No.: 09/084,900

[22] Filed: May 28, 1998

[30] Foreign Application Priority Data

Jun. 6, 1997 [JP] Japan ..... 9-149455

[51] Int. Cl.[7] ..... G08G 5/00

[52] U.S. Cl. ..... 701/120; 701/204; 342/36

[58] Field of Search ..... 701/15, 16, 120, 701/204, 300, 301; 340/945, 961, 971; 342/29, 30, 32, 36, 37, 38

[56] References Cited

U.S. PATENT DOCUMENTS

| | | | |
|---|---|---|---|
| 4,823,272 | 4/1989 | Inselberg | 701/120 |
| 5,058,024 | 10/1991 | Inselberg | 701/120 |
| 5,398,186 | 3/1995 | Nakhla | 701/204 |
| 5,714,948 | 2/1998 | Farmakis et al. | 701/120 |
| 5,842,142 | 11/1998 | Murray et al. | 701/204 |
| 5,941,929 | 8/1999 | Shiomi et al. | 701/120 |

*Primary Examiner*—Gary Chin
*Attorney, Agent, or Firm*—Venable; Robert J. Frank; Allen Wood

[57] ABSTRACT

An aircraft control system which assist in determining aircraft arrival orders and intervals, reduces controller's workloads, and ensures safe aircraft flight operation are provided. An aircraft position display system provided as part of a terminal flight control apparatus for controlling the operation of an airport terminal with the use of radar and so forth employs a plurality of tags, each displaying on a first display screen a flight control instruction composed of heading data, altitude data, and speed data, a change arrangement for allowing a user to change the heading data, altitude data, and/or speed data of the tag independently according to the flight control instruction, a display arrangement for use in a flight control instruction input mode, an arrangement for blinking an entered flight control instruction until a pilot acknowledges the instruction, an arrangement for returning the mode to the original mode when the pilot acknowledges the instruction, and an arrangement for registering final approach FIX (F) data.

20 Claims, 13 Drawing Sheets

AIRCRAFT CONTROL SYSTEM

BACKGROUND OF THE INVENTION

1. Field of the Invention

The present invention relates to an aircraft control system, in particular to an aircraft control system installed in airports which controls arrival of aircraft.

2. Description of the Prior Art

Various aircraft control systems have been developed. A conventional system displays the position of an aircraft based on a predicted time at which the aircraft flying along a standard arrival route (STAR) or a pre-registered flight route, passes a specific FIX.

However, in actual flight control operations, a controller in an airport sometimes instructs an aircraft not to fly along the STAR. The controller decides the arrival order of a plurality of aircraft, while viewing the radar screen, by predicting a time at which each aircraft will pass the final FIX. In doing so, the controller assumes that the aircraft first passes a virtual position (hereinafter, referred to as a common point) and then passes the final approach FIX. After determining the order, the controller prepares an instruction to be sent to each aircraft so that a plurality of aircraft will approach the airport in the decided order and at safe intervals, and sends the instruction to the pilot using voice signals.

Since those operations require experience skills, and knowledge, an inexperienced controller may have difficulties in determining the arrival order of aircraft.

SUMMARY OF THE INVENTION

It is therefore an object of the present invention to provide an aircraft control system in an airport which arranges the arrival order of aircraft at the airport based upon the time at which the aircraft reach a given point laid away from the airport, the aircraft control system comprising: an acquiring circuit which acquires data on the position and speed of the aircraft; a setting circuit which imaginarily sets an arbitrary point laid farther than the given point from the airport; a forming circuit which imaginarily forms a line passing through the given point and the arbitrary point; an presuming circuit which presumes a route along which the aircraft will fly, based upon the line and the position of the aircraft; and a predicting circuit which predicts time at which the aircraft will reach the given point, based upon the presumed route and the speed of the aircraft.

BRIEF DESCRIPTION OF THE DRAWINGS

The present invention will be understood more fully from the detailed description and the accompanying drawings below of the preferred embodiments of the invention.

In the drawings.

DESCRIPTION OF THE PREFERRED EMBODIMENTS

Figure 1:
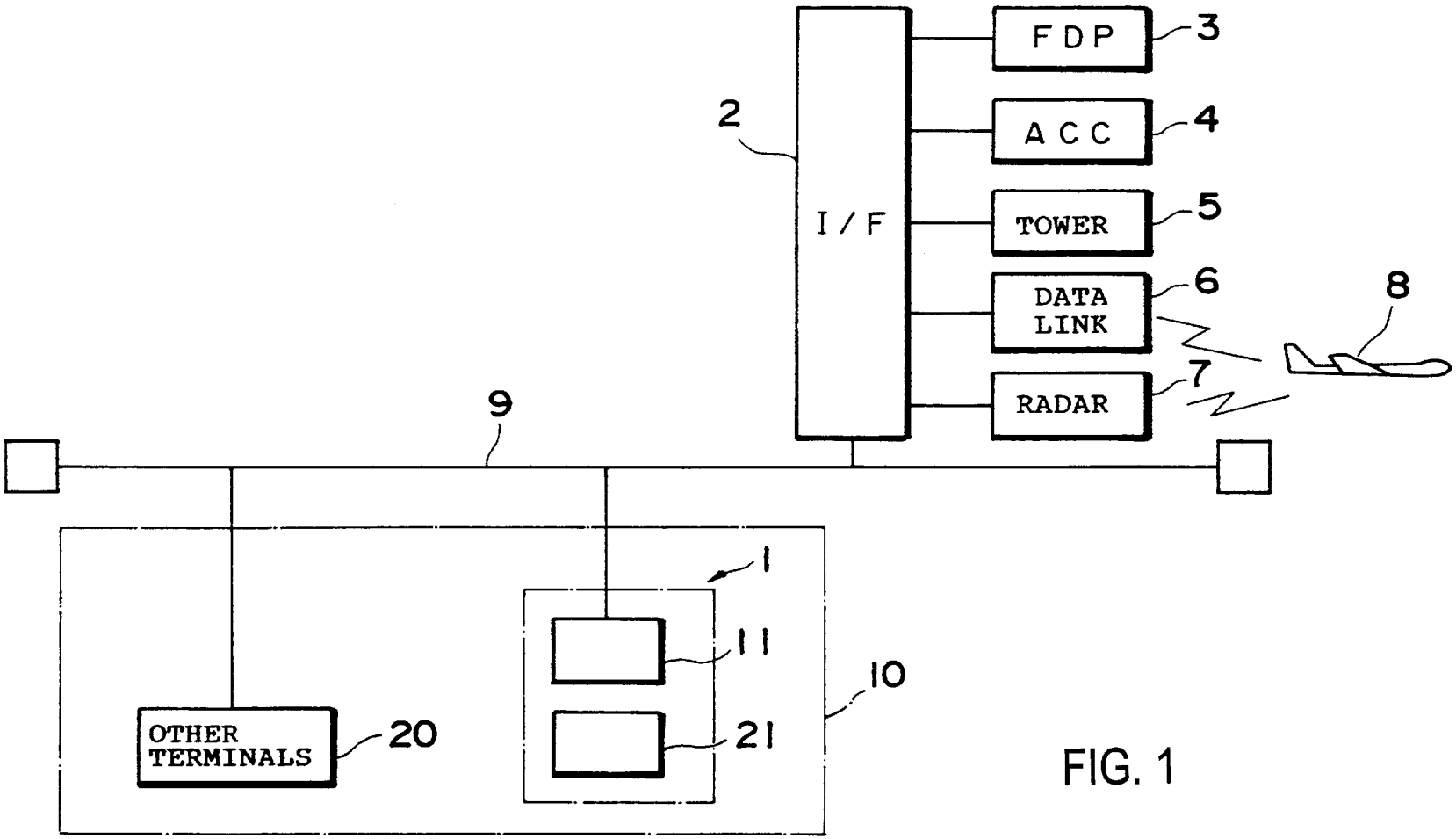
FIG. 1 is a diagram showing an overall configuration of a flight control system of an embodiment of the present invention.

An embodiment of the present invention is described in detail with reference to the accompanying drawings. FIG. 1 is a diagram showing the overall configuration of an flight control system of the embodiment according to the present invention. As shown in this figure, a terminal flight control apparatus 10, connected to a LAN 9, communicates digitally via an interface 2 with controllers on an FDP (Flight Data Processing System) 3, an ACC (Area Control Center) 4, and a tower (control tower control) 5 and with an aircraft 8. It also has a data link 6 and a radar 7 via which the position data, heading data, altitude data, and speed data on the aircraft 8 are obtained. In addition, the terminal flight control apparatus 10 is connected to the other terminals 20 via the LAN 9.

The data link 6 may use one of the following communication methods: (1) Satellite communication, (2) VHF communication (VDL: VHF digital link), and (3) Secondary radar (SSR) communication. On the terminal flight control apparatus 10 is provided a main-control terminal 1 which determines the final approach FIX passage order of a plurality of aircraft 8 arriving the airport and which sends and receives flight control instructions to or from pilots to control aircraft 8.

Figure 2:
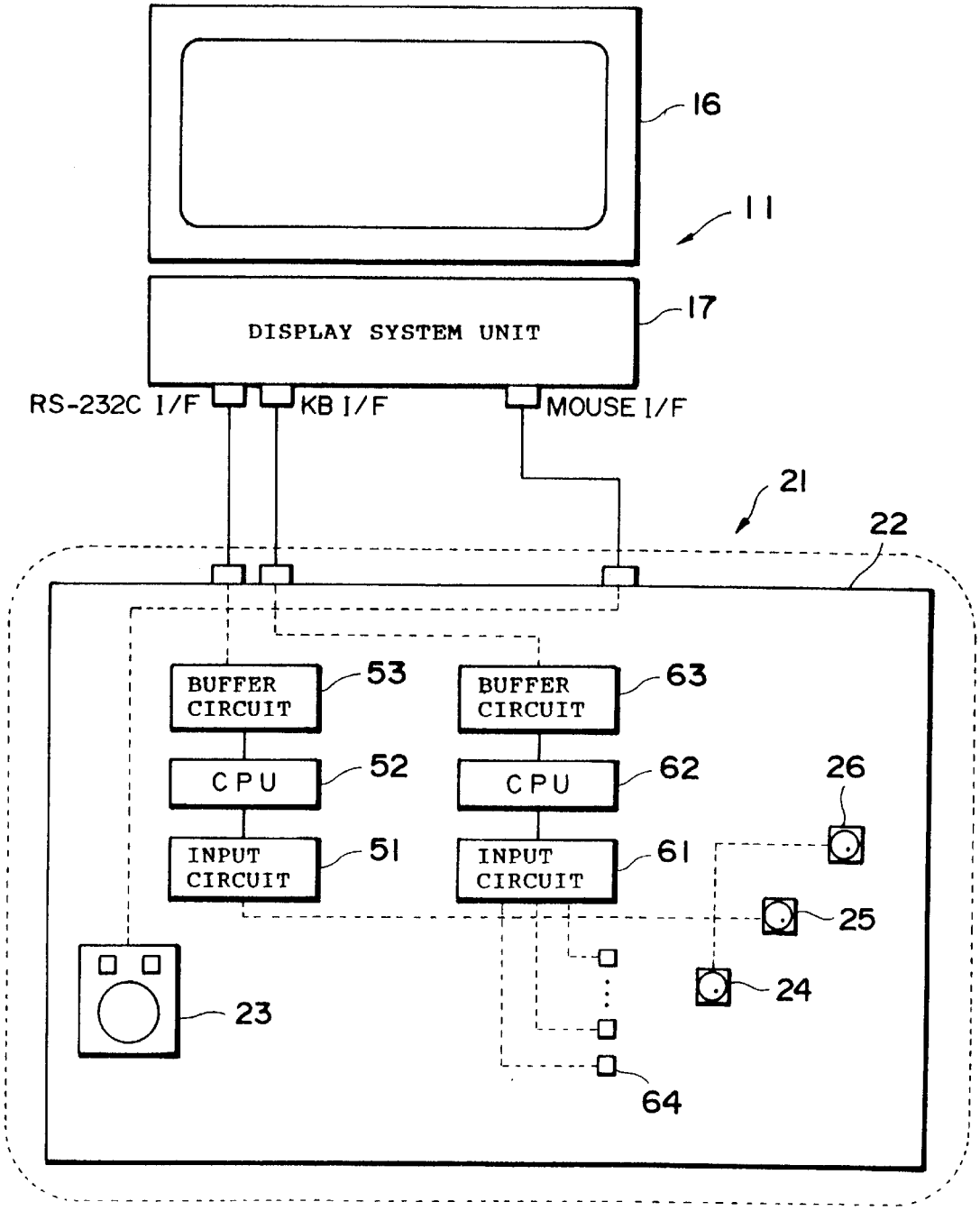
FIG. 2 is a diagram showing an outline configuration of a main-control terminal used in the embodiment of the present invention.

FIG. 2 is an outline configuration diagram of a main-control terminal. An example of the detailed configuration of a flight control instruction input unit will be explained later in FIG. 4. The main-control terminal 1 has a display unit 11 of the terminal flight control apparatus 10 and a flight control instruction input unit 21 used with the apparatus.

The display unit 11 on the above-described terminal flight control apparatus 10 is composed of a display screen 16 and a display system unit 17. The flight control instruction input unit 21 has a track ball 23, a heading dial 24, an altitude dial 25, a speed dial 26, and various buttons 64 on an operation panel 22. The track ball 23, with a function equivalent to that of a mouse, is connected to the display system unit 17 via a mouse interface (mouse I/F).

In addition, the heading dial 24, altitude dial 25, and speed dial 26 are connected to the display system unit 17 via an input circuit 51, a CPU (central processing unit) 52, a buffer circuit 53, and an RS-232C-I/F. Various buttons 64 are connected to the display system unit 17 via an input circuit 61, a CPU (central processing unit) 62, a buffer circuit 63, and a keyboard (KB I/F) interface.

The display is an aircraft position display of a terminal flight control apparatus which controls aircraft flight operation in an air traffic control operators facility using radar and so forth, The display comprises a plurality of tags each displaying a flight control instruction such as heading data, altitude data, and speed data on a first display screen, changing means for enabling a user to independently change the heading data, altitude data, and speed data of the tag corresponding to the control instruction, means for displaying data in a flight control instruction input mode, means for blinking or flashing the instruction after flight control instruction entry until a pilot acknowledges the instruction, and means for returning the mode to an original mode when the pilot acknowledges the instruction. Concerning the above, the disclosure in the Japanese Patent Application No. 8-152712 is incorporated herein by reference.

Figure 3:
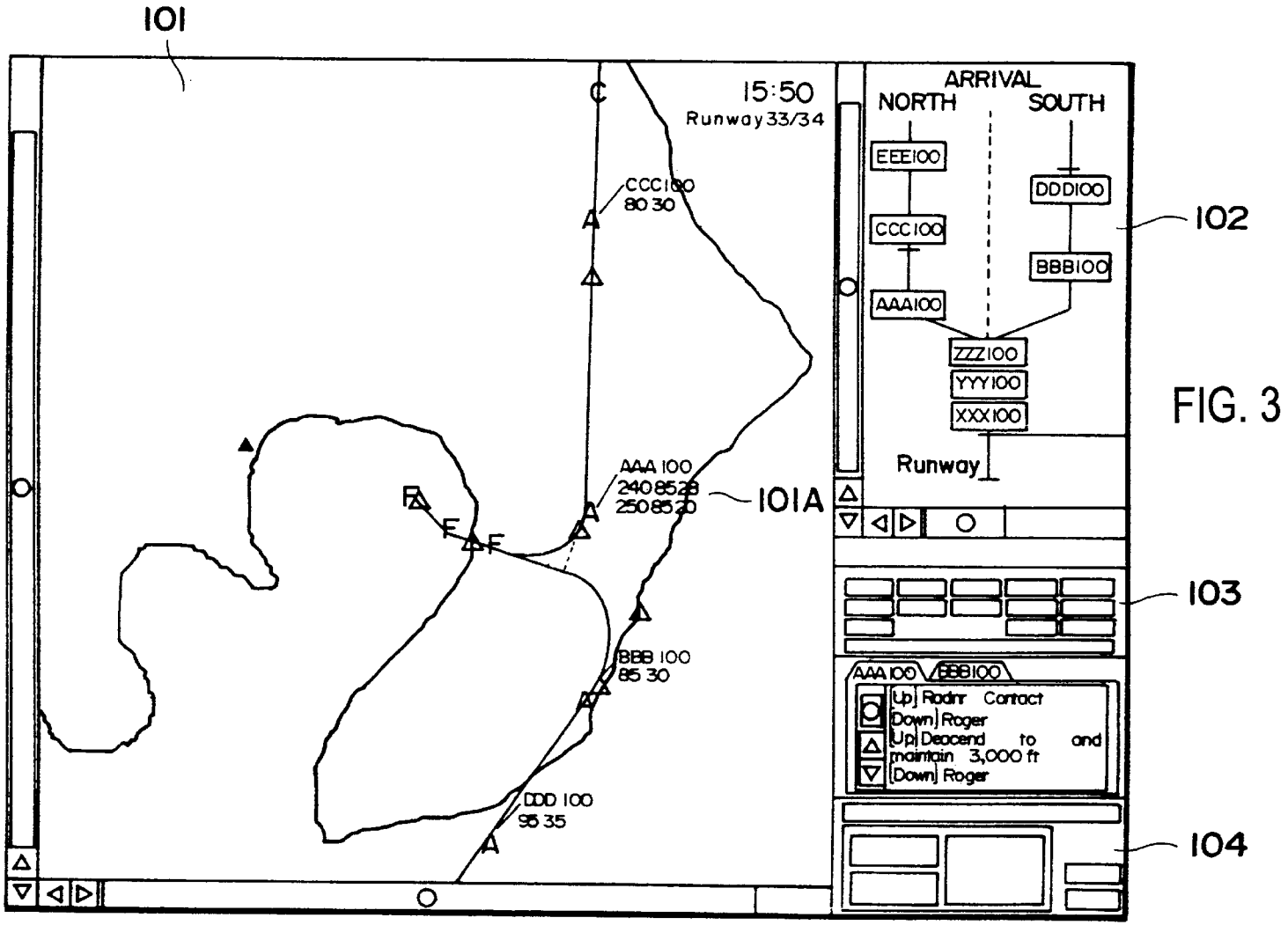
FIG. 3 is diagram showing an overall configuration of a display unit on an airport terminal flight control apparatus used in the embodiment of the present invention.

Next, the screen configuration of the display unit 11 of the main-control terminal 1 is described. FIG. 3 is the overall configuration diagram of the display unit on the terminal flight control apparatus used in the embodiment of the present invention. As shown in FIGS. 1 and 3, the screen of the main-control terminal 1 has an aircraft position display area 101 on the left side, a order display area 102 in the top right corner, and an aircraft data display area 103 near the bottom right corner.

In the aircraft position display area 101, information on the current positions and heading directions of aircraft, each indicated by a tag 101A, is displayed. Relevant to the tag display method, the disclosure in the Japanese Patent Application No. 8-152712 is incorporated herein by reference.

A time at which each arrival aircraft is to pass a specific FIX is displayed in the order display area 102, and aircraft data is displayed in the aircraft data display area 103. Reference numeral 104 denotes a flight control instruction preparation screen (also referred to as a CPDLC (Controller Pilot Data Link Communication) message preparation screen) on which flight control instructions are prepared and displayed.

Figure 4:
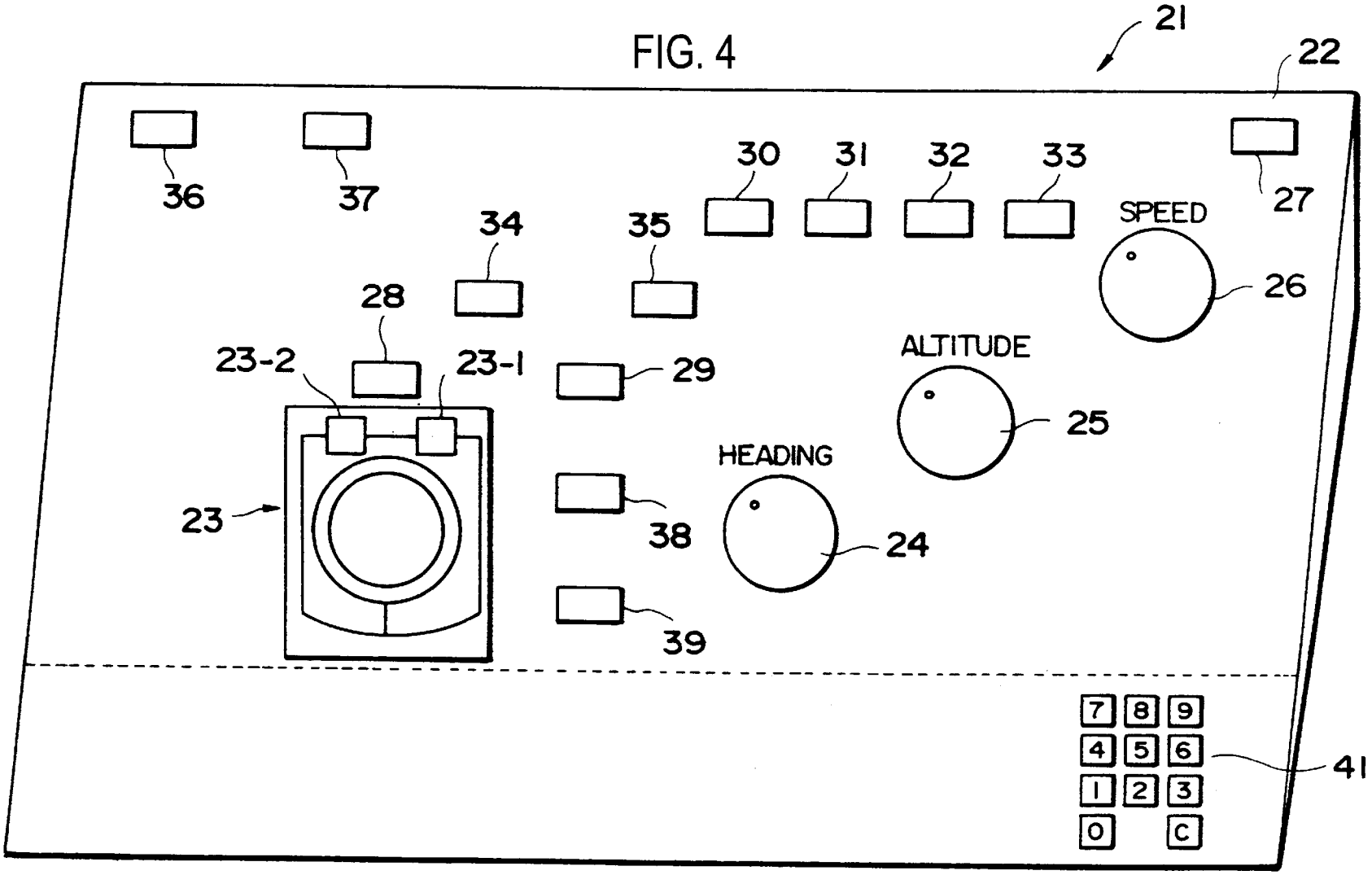
FIG. 4 is a diagram showing an example of an flight control instruction input system on the control apparatus used in the embodiment of the present invention.

FIG. 4 shows an example of a flight control instruction input unit on the control apparatus of the embodiment according to the present invention. As shown in this figure, an operation panel 22 of the flight control instruction input unit 21 of the main-control terminal 1 has the track ball 23 with a right button 23-1 and a left button 23-2, a HEADING dial 24, an ALTITUDE dial 25, a SPEED dial 26, a TRANSMIT (flight control instruction transmission) button 27, a DRAG button 28, a ROGER button 29, an APPROACH CLEARANCE button 30, a ROUTE CLEARANCE button 31, a FLY button 32, a MAINTENANCE button 33, a HAND-OFF button 34, an ACCEPT button 35, a CANCEL button 36, an R.CONTACT (radar contact) button 37, a NEGATIVE (NO) button 38, an AFFIRM (YES) button 39, and a time input keypad 41.

The following outlines the major functions of the operation unit. The track ball 23 has a function equivalent to that of a mouse. The HEADING dial 24 is used to edit angle or direction values. On the flight control instruction preparation screen 104, TURN [direction] and HEADING [angle] are displayed as default. Selecting GRAND TRACK or REVERSE via the GUI (Graphical User Interface) changes the messages on the flight control instruction preparation screen 104 to TURN [direction], GRAND TRACK [angle], and TURN [angle][direction].

The HEADING dial 24 is an electric pulser, which operates as follows. A heading value is specified as a difference from the current heading value of the aircraft. Turning the dial right increase the value, and turning left decreases the value, both in increments of 10°. The default is RIGHT when the value is within 180° right of the value of the selected aircraft (including the current heading value), and is LEFT when the value is within 180° left of the value of the selected aircraft (including the current heading value).

Next, the ALTITUDE dial 25 is used to edit altitude values. On the flight control instruction preparation screen 104, CLIMB (DESCEND) TO AND MAINTAIN [altitude] is displayed as default. Selecting EXPEDITE or IMMEDIATELY via the GUI interface changes the messages displayed on the flight control instruction preparation screen 104 to EXPEDITE CLIMB (DESCEND) TO [altitude] or IMMEDIATELY CLIMB (DESCEND) TO [altitude].

The SPEED dial 26 is used to edit speed values. On the flight control instruction preparation screen 104, INCREASE (REDUCE) SPEED TO is displayed as default. Selecting EXPECT or DO NOT EXCEED using the GUI interface changes the message displayed on the flight control instruction preparation screen 104 to EXPECT [speed] or to DO NOT EXCEED [speed], respectively.

Next, the functions of the buttons on the operation panel are described. Pressing the TRANSMIT 27 button 27 sends ATC.UP LINK messages (flight control instructions from a control facility to a pilot), prepared on the flight control instruction preparation screen 104, to a selected aircraft. Pressing the DRAG button 28 puts a selected object in the drag state. Pressing the button again drops the selected object (the left button 23-2 on the track ball releases the drag state). Pressing the ROGER button 29 sends a ROGER (understand a message) message to a selected aircraft. Pressing the HAND OFF button 34 sends a hand-off message to a receiving control facility. Pressing the ACCEPT button 35 sends an accept message to a sending control facility. Pressing the CANCEL button 36 cancels data displayed on the flight control instruction preparation screen 104. These operation buttons, arranged as shown in the figure, may be operable independently.

Figure 5:
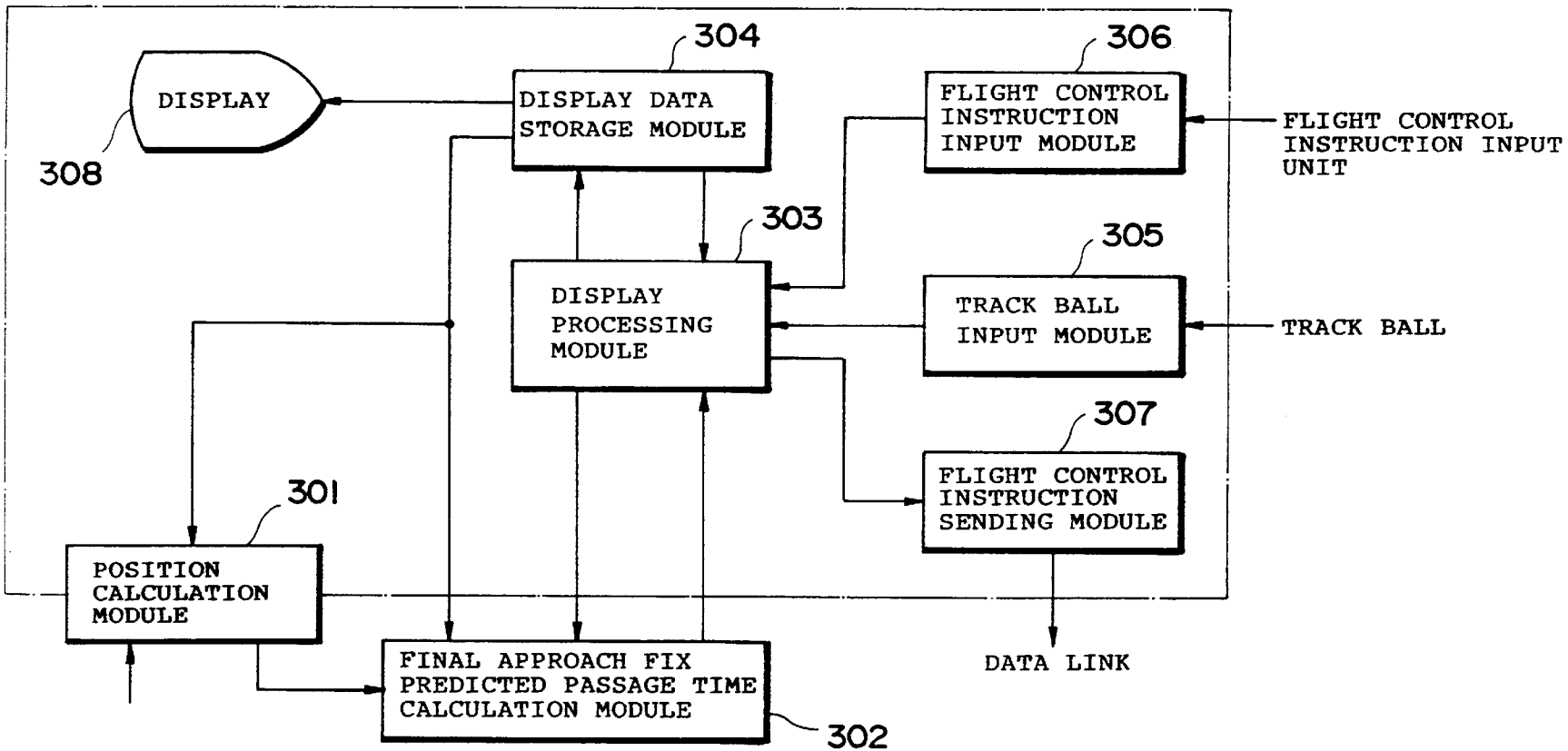
FIG. 5 is a functional block diagram of the units on the control apparatus used in the embodiment of the present invention.
Figure 6:
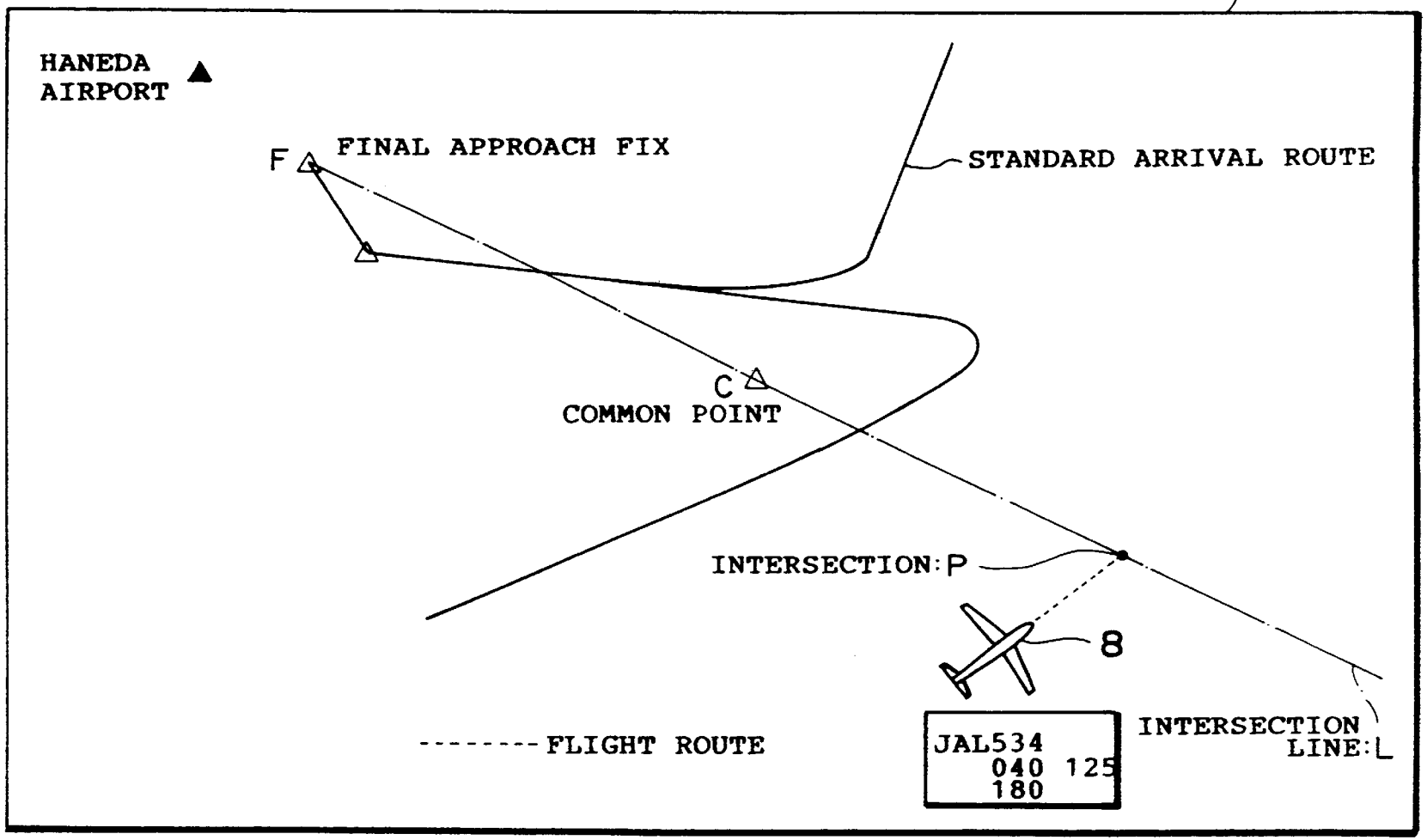
FIG. 6 is a diagram showing an aircraft position display area on the control apparatus used in the embodiment of the present invention.
Figure 9:
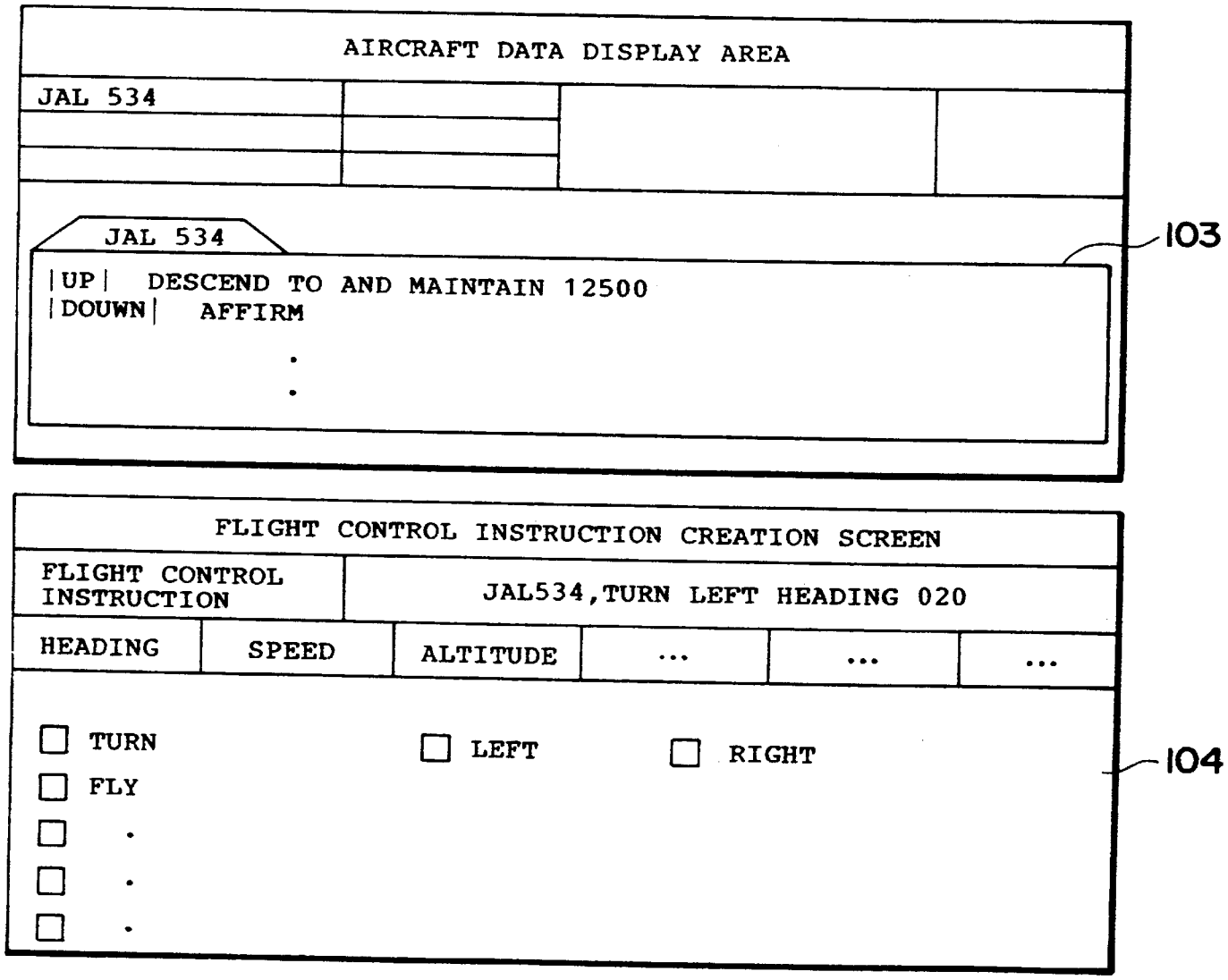
FIG. 9 is a diagram showing an aircraft data display area and a flight control instruction preparation screen on the control apparatus used in the embodiment of the present invention.
Figure 10:
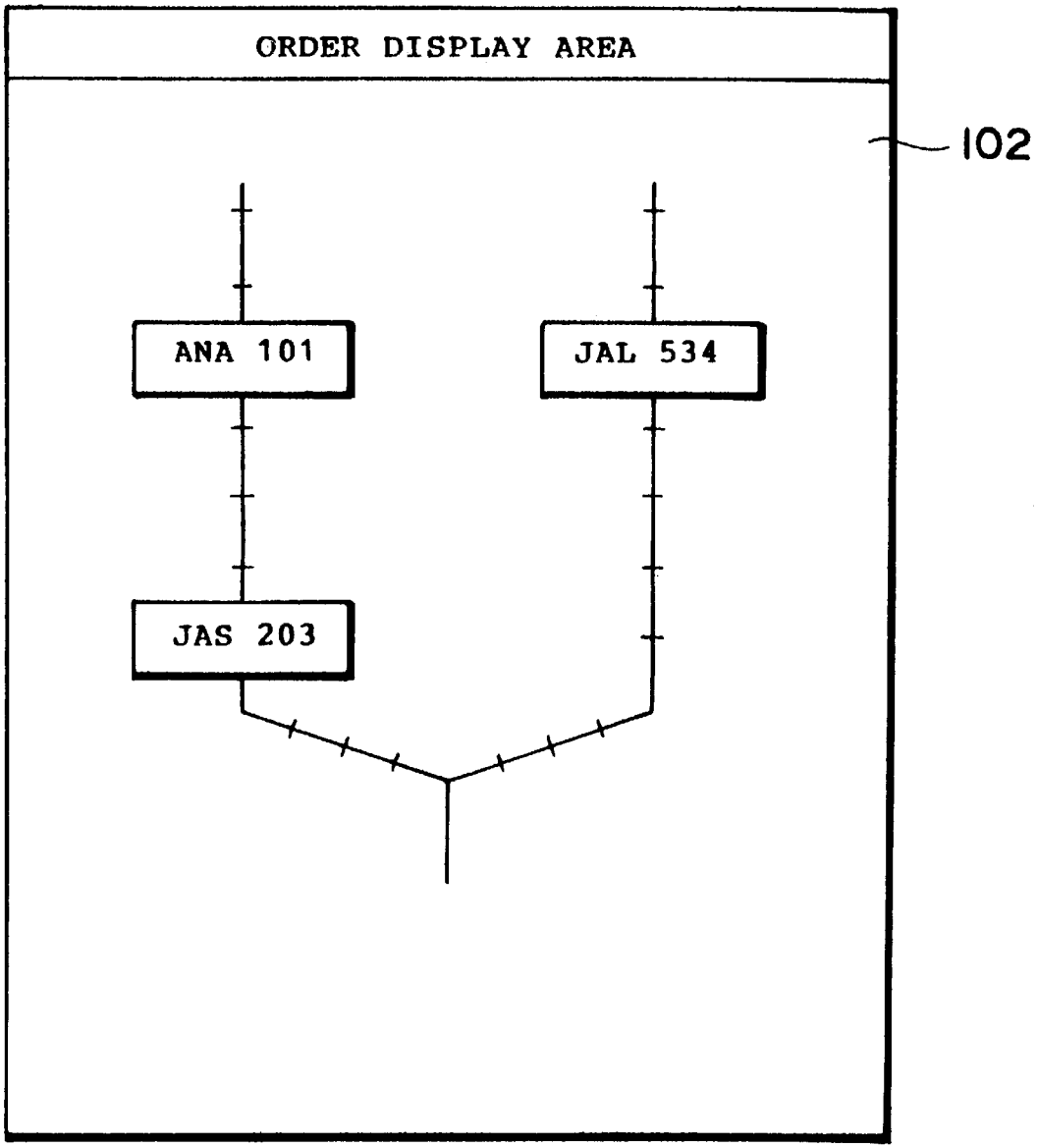
FIG. 10 is a diagram showing a order display area (1) on the control apparatus used in the embodiment of the present invention.

FIG. 5 is a functional block diagram of the units on the control apparatus used in the embodiment of the present invention. FIG. 6 is a diagram showing the aircraft position display area on the control apparatus used in the embodiment of the present invention. FIG. 9 is a diagram showing the aircraft data display area and a flight control instruction preparation screen on the control apparatus used in the embodiment of the present invention. FIG. 10 is a diagram showing the order display area (1) on the control apparatus used in the embodiment of the present invention.

In FIG. 5, reference numeral 301 denotes an aircraft position calculation module, reference numeral 302 denotes a final approach FIX predicted-passage-time calculation module, reference numeral 303 denotes a display processing module, number 304 is a display data storage module, reference numeral 305 denotes a track ball input module, reference numeral 306 denotes a flight control instruction input module, reference numeral 307 denotes a flight control instruction sending module, and reference numeral 308 denotes a display.

The aircraft position calculation module 301 receives position data (altitude, latitude and longitude), heading data, and speed data, etc., from such units as the radar 7 shown in FIG. 1 and receives final approach FIX (F) position data and common point (C) position data from the display data storage module 304 as shown in FIG. 6. And, based on the received data, the module calculates an intersection (hereinafter referred to as an intersection (P)) where the line extending directly into the current heading direction of the aircraft meets the line (L) joining the final approach FIX (F) to the common point (C) (hereinafter, referred to as a "final-approach-FIX to common-point line").

Figure 7:
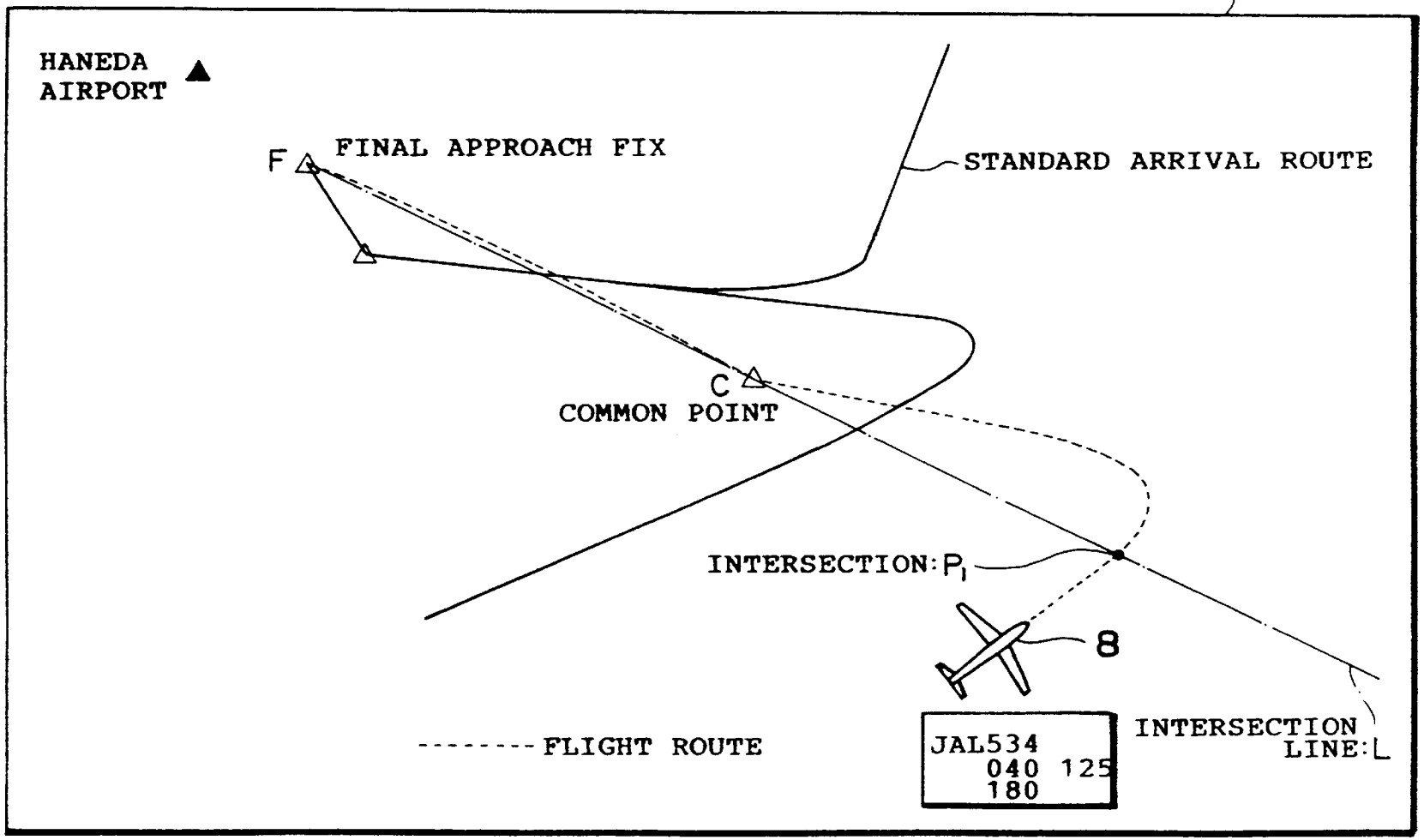
FIG. 7 is a diagram showing an example (1) of a flight route displayed in an aircraft position display area on the control apparatus used in the embodiment of the present invention.
Figure 8:
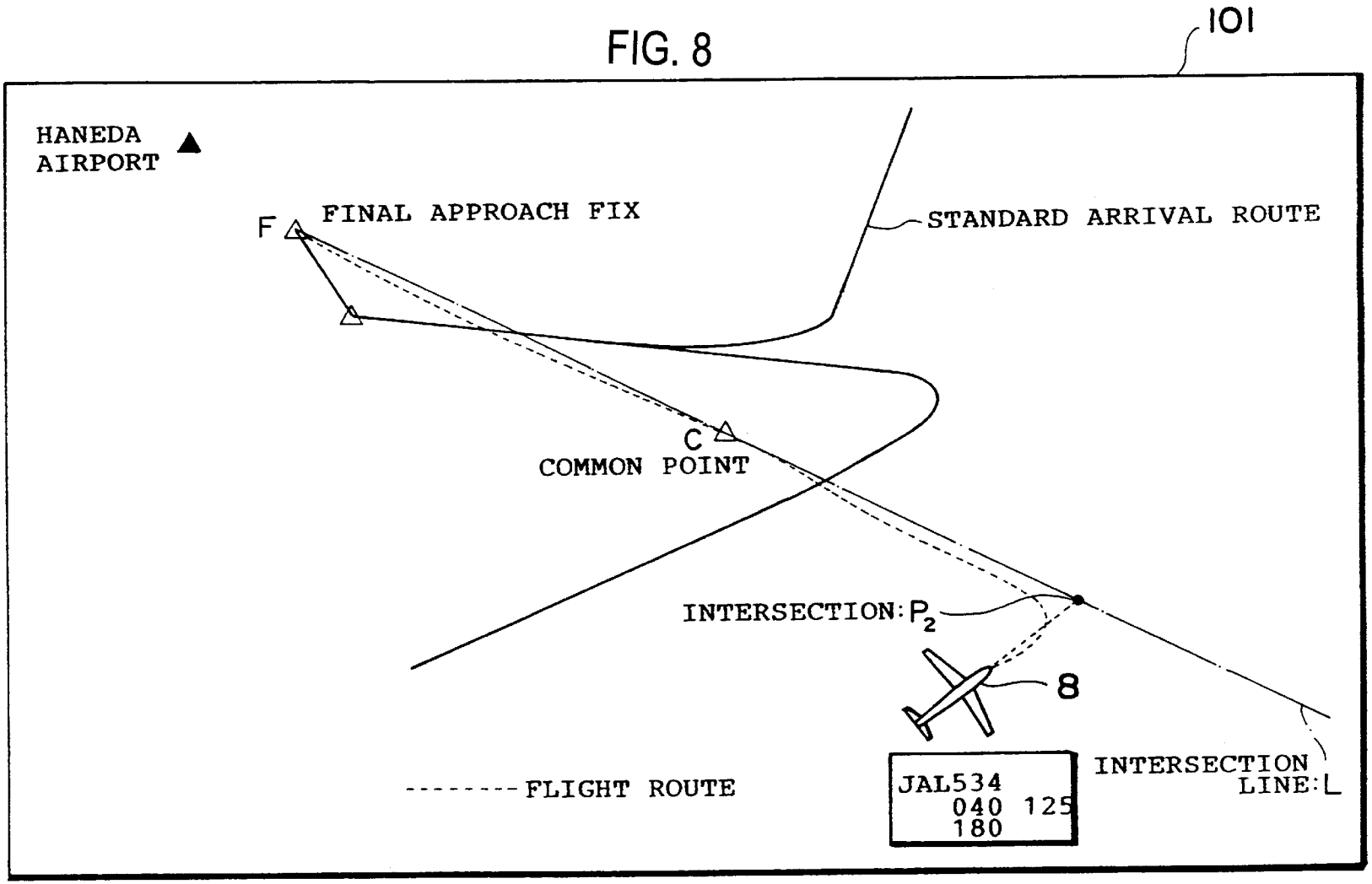
FIG. 8 is a diagram showing an example (2) of a flight route displayed in an aircraft position display area on the control apparatus used in the embodiment of the present invention.

This intersection calculation method also applies to the intersection (P1) that is calculated when the aircraft 8 passes through the intersection line (L) before heading for the common point (C) as shown in FIG. 7 and to the intersection (P2) that is calculated when the aircraft 8 changes its direction before reaching the intersection line (L) and then heads for the common point (C) as shown in FIG. 8.

The final approach FIX predicted-passage-time calculation module 302 uses three-point position data [final approach FIX (F), common point (C), and intersection (P)] sent from the aircraft position calculation module 301 and aircraft data such as the current speed or altitude to calculate the final approach FIX predicted-passage-time of the aircraft. The display processing module 303 displays aircraft approaching the "final-approach-FIX to common-point line" from North and aircraft approaching that line from South, separately. Based on the predicted passage time of each aircraft, the module displays symbols, each representing an aircraft, so that the interval between two symbols is proportional to the actual interval. The display data storage module 304 displays data sent from the display processing module 303 on the display 308. It also stores the data. The track ball input module 305 receives data on the cursor position and on whether or not the button on the track ball 23 was pressed from the track ball 23, and sends the data to the display processing module 303. The flight control instruction input module 306 receives flight control instruction data from the flight control instruction input unit 21 and the aircraft data display area 103 and sends it to the display processing module 303. The flight control instruction sending module 307 receives the flight control instruction data and identified aircraft data from the display processing module 303 and sends flight control instructions to the aircraft via the data link 6.

The following explains the steps that are performed during operation.

(1) A final approach FIX (F) is registered through the aircraft position display area 101 of the display 308. (An example of how to register a final approach FIX (F) is described below. In the following description, it is assumed that a final FIX (F) is registered in real time).

1̂ When a unique final approach FIX (F) is determined from the runway to be used, the final approach FIX (F) is automatically registered, even though not being selected.

2̂ When a plurality of final approach FIX (F) candidates are displayed on the aircraft position display area 101 using symbols such as Δ, one of them may be selected, for example, with the track ball 23.

3̂ The text input field for the final approach FIX (F) name is displayed. Type the final approach FIX (F) name in that text input field. Then, the final approach FIX (F) is registered.

4̂ Selecting the check box for registering the final approach FIX (F), registers the final approach FIX(F). The final approach FIX (F) may be registered either by typing the final approach FIX (F) name or by checking the check box for the final approach FIX (F) to be registered.

(2) After step (1), a common point (C) may be registered and displayed in the aircraft position display area 101 of the display 308.

In the following description, it is assumed that a common point (C) may be registered in real time. An example of how to register a common point (C) is described below.

1̂ First, type the latitude and longitude of a point to register and display the point as a common point (C).

2̂ Select any point in the aircraft position display area 101 with the pointing device. The selected point is registered and displayed as a common point (C).

3̂ After steps (1) and (2) described above, a line (L) through two points, the final approach FIX (F) and the common point (C), is drawn automatically in the aircraft position display area 101, as shown in FIG. 6. Each time a common point (C) and/or a final approach FIX (F) are registered, the line L is re-drawn in the aircraft position display area 101 of the display 308.

(4) The aircraft position calculation module 301 receives final approach FIX (F) data and common point (C) data from the display data storage module 304, and such data as the current position and heading of each aircraft from the radar 7 and so forth. Based on that data, the module calculates for each aircraft the point (hereinafter referred to as an intersection (P)) where the line drawn in step (3) above and the flight route of each aircraft meet.

(5) The final approach FIX-predicted-passage time calculation module 302 receives three-point data [final approach FIX (F), common point (C), intersection (P) of each aircraft], current speed data, current latitude data, etc., from the aircraft position calculation module 301 and, based on that data, calculates the final approach FIX predicted-passage-time of each aircraft.

(6) The final approach FIX predicted-passage-time of each aircraft, calculated in step (5) above, is sent to the display processing module 303 for display. The data is then sent to the display data storage module 304, and the symbol of the aircraft is displayed in the order display area 102 of the display 308.

(7) The controller checks what is displayed in step (6) above to know the order in which arriving aircraft will pass the final approach FIX (F) and the time at which each aircraft will pass the final approach FIX (F).

(8) Immediately after the position of an aircraft flying in the heading direction changes, new change position data is sent to the final approach FIX predicted-passage-time calculation module 302 to calculate the final approach FIX predicted-passage-time.

(9) Actual flight control instructions are issued as described in the following example.

From the aircraft position display area 101 shown in FIG. 6, the controller selects a target aircraft (JAL534) flying in the heading angle of 040 degrees and prepares a flight control instruction "TURN LEFT HEADING 020" via the flight control instruction input unit 21 shown in FIG. 4. The controller checks the flight control instruction "JAL534, TURN LEFT HEADING 020" shown in FIG. 9 and presses the TRANSMIT button 27 on the flight control instruction input unit 21 shown in FIG. 4 to send the flight control instruction to the pilot of the aircraft.

(10) After the flight control instruction is sent as described in step (9) above, the final approach FIX predicted-passage-time is re-calculated using the current heading data (20°, that is, 020) on the aircraft.

(11) The final approach FIX predicted-passage-time of the aircraft, re-calculated in step (10), is sent to the display processing module 303. The data is then sent to the display data storage module 304 and is displayed in the order display area 102 of the display 308.

(12) When another flight control instruction affecting the flight of the aircraft (for example, a flight control instruction to change the speed) is sent, changed data is sent to the final approach FIX predicted-passage-time calculation module 302 as in steps (9) to (11) above, to re-calculate the final approach FIX predicted-passage-time. The symbol representing the aircraft is re-displayed in the order display area 102.

Figure 11:
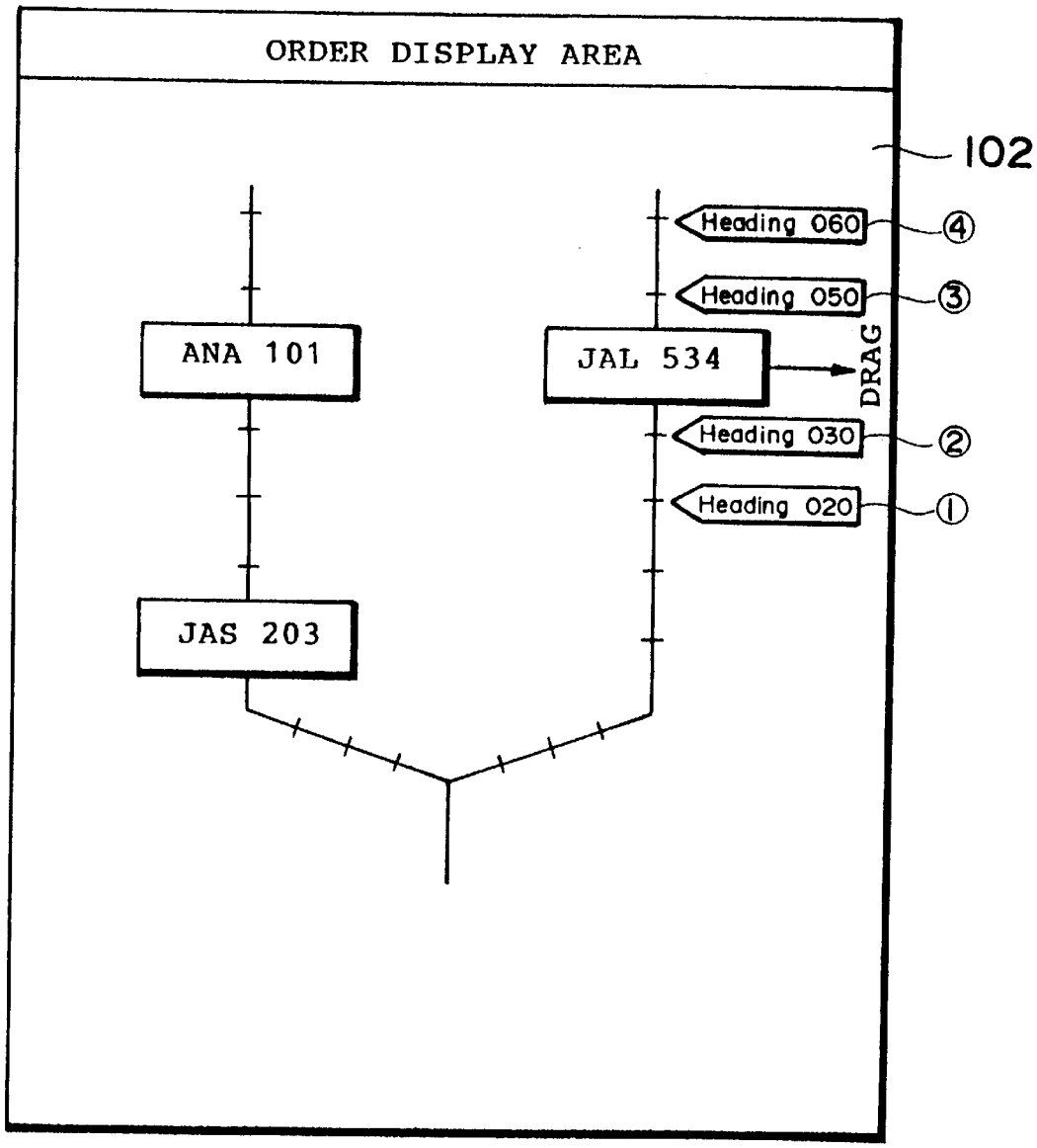
FIG. 11 is a diagram showing a order display area (2) on the control apparatus used in the embodiment of the present invention.
Figure 12:
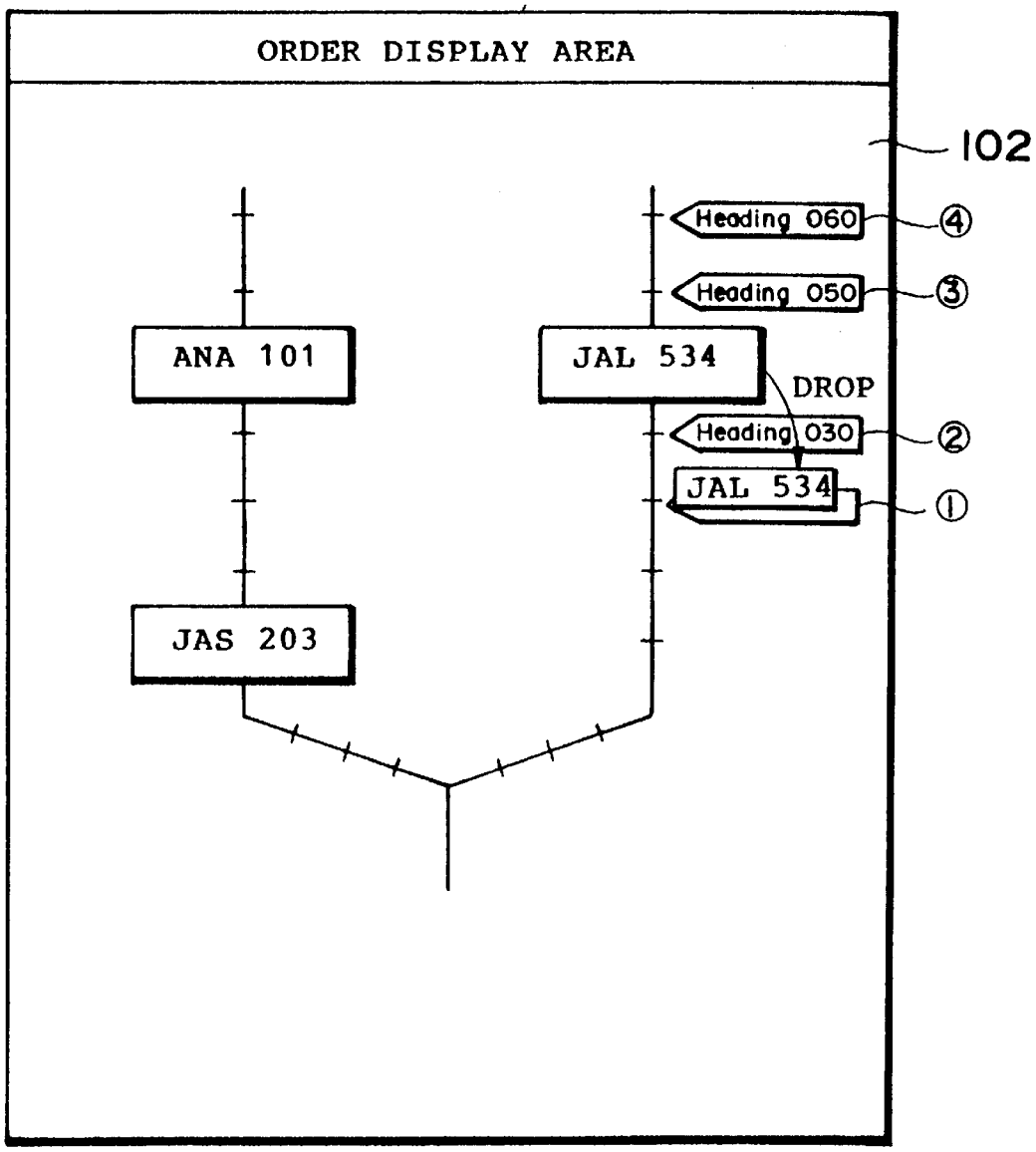
FIG. 12 is a diagram showing a order display area (3) on the control apparatus used in the embodiment of the present invention.

(13) When the controller uses the track ball 23 to select, from the order display area 102 shown in FIG. 10, a symbol representing an aircraft (JAL534) flying at the heading angle of 40 degrees and then drags the selected symbol, a plurality of heading symbols, each at a position corresponding to a final approach FIX predicted-passage-time, are displayed in increments of 10°. For example, if the current heading value is 40° in FIG. 11, then $\hat{1}$ is a position when the heading value is 20° (020), $\hat{2}$ is a position when the heading value is 30° (030), $\hat{3}$ is a position when the heading value is 50° (050), and $\hat{4}$ is a position when the heading value is 60° (060).

Dragging the aircraft symbol to the heading symbol "Heading 020" allows the flight control instruction indicated by the value in the heading symbol to be displayed on the flight control instruction preparation screen 104. In this case, "JAL534, TURN LEFT HEADING 020" is displayed by default, as shown in FIG. 9. This is done by selecting an aircraft symbol and pressing the DRAG button 28 (see FIG. 4). Then, the selected object is put in the drag state. Pressing the button again drops the selected object.

(14) After the controller checks the flight control instruction shown in FIG. 9 and drops the aircraft symbol onto the heading symbol, the prepared flight control instruction is sent to the pilot of the aircraft. The final approach FIX predicted-passage-time of the aircraft is updated and, based on the updated result, flight order data is displayed on the order display area 102.

Figure 13:
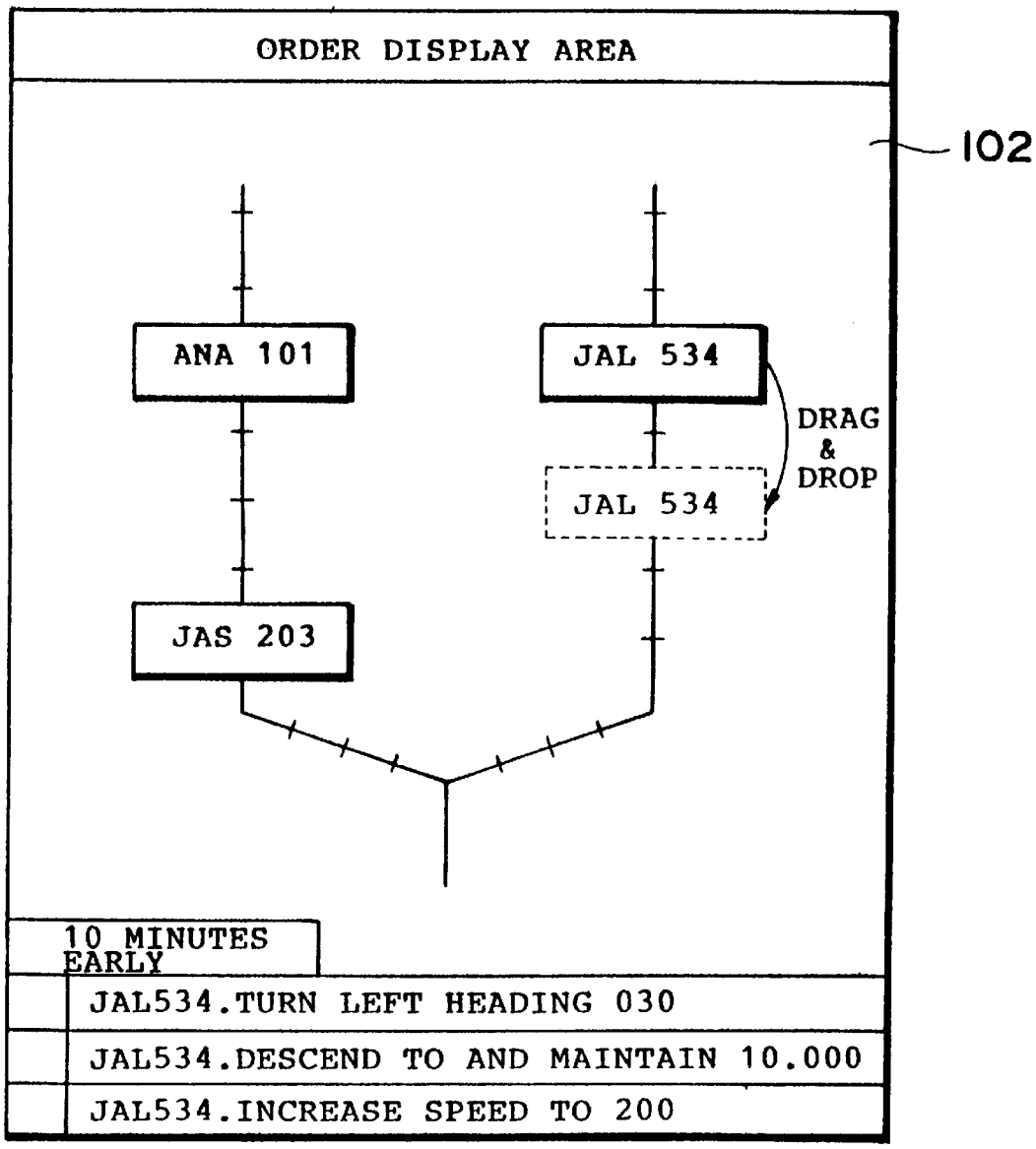
FIG. 13 is a diagram showing a order display area (4) on the control apparatus used in the embodiment of the present invention.

(15) Selecting and dragging the aircraft symbol (JAL534) shown in FIG. 10 with the use of the track ball 23 displays the flight control instructions as shown in FIG. 13. These flight control instructions indicate a change in the heading value, altitude value, and speed value, respectively, necessary for the aircraft to pass the final approach FIX earlier by a period of the time corresponding to the amount of movement by which the aircraft symbol was dragged.

(16) Selecting one of displayed flight control instructions from the display shown in FIG. 13 displays the selected flight control instruction on the flight control instruction preparation screen 104. After checking the selected flight control instruction, the controller presses the TRANSMIT button 27 to send the flight control instruction to the pilot of the aircraft and to re-display the aircraft symbol on the order display area 102.

(17) The method described above allows the final approach FIX predicted-passage-time of an aircraft to be updated each time aircraft position data is updated or each time a flight control instruction affecting the aircraft flight is sent. to the pilot.

(18) The controller checks the final approach FIX predicted-passage-time of each aircraft and the passage order in the order display area 102 while checking the actual position of each aircraft in the aircraft position display area 101.

A conventional system predicts the passage time of a specific point for an aircraft flying over the standard arrival route or a registered flight route. A system according to the present invention does more. It helps the controller determine the arrival order of aircraft flying over the above-described routes and set up intervals, preventing the flight control operation load from being increased and ensuring safe aircraft flight.

The present invention finds the following applications.

In the above embodiment, an airport terminal flight control apparatus is described. The present invention may also be applied to a flight route control apparatus by selecting specific positions on a flight route for a final approach FIX (F) and a common point (C).

A system according to the present invention may be used with a plurality of terminal controllers. In such a case, the present invention may be applied to a main-control terminal which determines the arrival order of aircraft.

The user interface system provided on the terminal flight control apparatus for sequencing a plurality of aircraft may be also applied to a FEEDER main-control terminal, which controls arriving aircraft near an airport in the approach control area to order a plurality of arriving aircraft at an appropriate interval, and to an arrival flight sub-control terminal which coordinates with other control facilities or controllers (usually, departure sub-controller), reports the result to the main-control terminal, and sends prompt messages to the controller at the maincontrol terminal to do coordinated work.

It is to be understood that the present invention is not limited to the embodiment described above and that the invention may be embodied in other specific forms without departing from the sprit or essential characteristics thereof.

As described above, the present invention has the following advantages.

An orderly, reliable aircraft arrival sequencing operation on the terminal flight control apparatus, combined with an efficient use of a data link, reduces the controller's workload and provides the controller with a user interface system which ensures smooth aircraft sequencing operation.

More specifically, the apparatus according to the present invention gives easy-to-understand aircraft arrival order and interval information, allowing any controller to do flight control operation easily.

Dragging an aircraft symbol from one position to another displays easy-to-understand information on the final approach FIX predicted-passage-time and the aircraft arrival interval that would result if the aircraft followed a flight control instruction that changes the current heading value, current altitude value, and/or the current speed value.

In addition, when a time is specified, the apparatus according to the present invention tells the controller how much the heading value, altitude value, and/or speed value must be changed in order for the aircraft to pass the final approach FIX (F) at the specified time. This also reduces the controller's workload.

What is claimed is:

1. An aircraft control system, for use at an airport where a plurality of aircraft arrive in an arrival order, to determine a position in the arrival order of a particular aircraft based upon a time at which the particular aircraft reaches a given point located away from the airport, the aircraft control system comprising:

an acquiring circuit which acquires data on the position and speed of the particular aircraft;

a setting circuit which sets an arbitrary point located farther than the given point from the airport;

a forming circuit which forms a line passing through the given point and the arbitrary point;

a presuming circuit which presumes a route along which the particular aircraft will fly, based upon the line and the position of the particular aircraft; and a predicting circuit which predicts a time at which the particular aircraft will reach the given point, based upon the presumed route and the speed of the particular aircraft.

2. An aircraft control system as set forth in claim 1, further comprising an indicating circuit which indicates the predicted time.

3. An aircraft control system as set forth in claim 2, further comprising an arranging circuit which determines the position in the arrival order of the particular aircraft based upon the predicted time, wherein the indicating circuit indicates the position of the particular aircraft in the arrival order.

4. An aircraft control system as set forth in claim 3, wherein the indicating circuit indicates the position in the arrival order in the form of a tag representing the particular aircraft.

5. An aircraft control system as set forth in claim 4, further comprising a rearranging circuit used for manually rearranging the position in the arrival order by moving the tag.

6. An aircraft control system as set forth in claim 5, further comprising an evaluating circuit which evaluates an operation of the particular aircraft necessary to satisfy the rearranged position in the arrival order.

7. An aircraft control system as set forth in claim 4, wherein the length of the tag in the advance direction of the particular aircraft denotes a distance to be kept between the particular aircraft and an adjacent aircraft.

8. A method, for use at an airport where a plurality of aircraft arrive in an arrival order, to determine a position in the arrival order of a particular aircraft based upon a time at which the particular aircraft reaches a given point located away from the airport, said method comprising the steps of:

acquiring data on the position and speed of the particular aircraft;

setting an arbitrary point located farther than the given point from the airport;

forming a line passing through the given point and the arbitrary point;

presuming a route along which the particular aircraft will fly, based upon the line and the position of the particular aircraft; and predicting a time at which the particular aircraft will reach the given point, based upon the presumed route and the speed of the particular aircraft.

9. A method according to claim 8, further comprising indicating the predicted time.

10. A method according to claim 9, further comprising determining the position in the arrival order of the particular aircraft based upon the predicted time, and indicating the position of the particular aircraft in the arrival order.

11. A method according to claim 10, wherein the position in the arrival order is indicated in the form of a tag representing the particular aircraft.

12. A method according to claim 11, further comprising manually rearranging the position in the arrival order by moving the tag.

13. A method according to claim 12, further comprising evaluating an operation of the particular aircraft necessary to satisfy the rearranged position in the arrival order.

14. A method according to claim 11, wherein the length of the tag in the advance direction of the particular aircraft denotes a distance to be kept between the particular aircraft and an adjacent aircraft.

15. A method for arranging an arrival order of a plurality of aircraft at an airport, said method comprising the steps of:

obtaining flight data for each aircraft;

setting a given point for each aircraft, the given point being located away from the airport;

setting an arbitrary point for each aircraft, the arbitrary point being located farther from the airport than the given point for that aircraft;

forming a line passing through the given point for each aircraft and the arbitrary point for that aircraft;

presuming a route for each aircraft based on the line for that aircraft and the flight data of that aircraft;

deriving a time for each aircraft to reach the given point for that aircraft based on the route and the flight data for that aircraft; and arranging the arrival order of the plurality of aircraft based on the derived times of all of the aircraft.

16. A method as set forth in claim 15, wherein the step of presuming a route for each aircraft comprises estimating an intersection between the line for that aircraft and a flight route of that aircraft, the flight route being determined from the flight data for that aircraft.

17. A method as set forth in claim 15, further comprising the step of rearranging the arrival order by instructing any of the aircraft to change the flight data thereof.

18. A method as set forth in claim 15, further comprising the step of displaying the arrival order in the form of symbols representing the aircraft, and the step of rearranging the arrival order by moving any of the symbols.

19. A method as set forth n claim 18, further comprising the step of estimating an operation of one of the aircraft necessary to achieve the rearranged arrival order.

20. A method as set forth in claim 18, wherein an interval between adjacent symbols is proportional to an actual distance between the corresponding aircraft.

* * * * *